US008241376B2

(12) United States Patent
Zhang et al.

(10) Patent No.: US 8,241,376 B2
(45) Date of Patent: Aug. 14, 2012

(54) SELF-CLEANING DEVICE OF FILTERING NET AND AIR CONDITIONER HAVING IT

(75) Inventors: Zhichun Zhang, Shandong (CN); Renzhen Chu, Shandong (CN); Shouxin Zhang, Shandong (CN); Yu Fu, Shandong (CN); Zhaozhi Yu, Shandong (CN); Jiangang Liu, Shandong (CN); Ting Yang, Shandong (CN); Baohua Gao, Shandong (CN)

(73) Assignees: Haier Group Corporation, Shandong (CN); Qingdao Haier Air Conditioner Gen Corp., Ltd., Shandong (CN)

( * ) Notice: Subject to any disclaimer, the term of this patent is extended or adjusted under 35 U.S.C. 154(b) by 335 days.

(21) Appl. No.: 12/596,319

(22) PCT Filed: Oct. 18, 2007

(86) PCT No.: PCT/CN2007/002981

§ 371 (c)(1),
(2), (4) Date: Dec. 11, 2009

(87) PCT Pub. No.: WO2008/128402

PCT Pub. Date: Oct. 30, 2008

(65) Prior Publication Data

US 2010/0116463 A1 May 13, 2010

(30) Foreign Application Priority Data

Apr. 18, 2007 (CN) ..... 2007 1 0097812

(51) Int. Cl.
*B01D 50/00* (2006.01)

(52) U.S. Cl. ..... 55/295; 55/289; 55/296; 165/5; 165/95; 165/DIG. 10; 165/DIG. 11; 62/303

(58) Field of Classification Search ..... 62/303–316; 55/289, 295–300; 165/4–10, 95, DIG. 10, 165/DIG. 11, DIG. 85, DIG. 8
See application file for complete search history.

(56) References Cited

U.S. PATENT DOCUMENTS 3,221,479 A * 12/1965 Moser et al. ..... 55/296

(Continued)

FOREIGN PATENT DOCUMENTS

| | | |
|---|---|---|
| CN | 1584435 A | 2/2005 |
| CN | 1759278 A | 4/2006 |
| CN | 1773185 A | 5/2006 |
| CN | 1932396 A | 3/2007 |

(Continued)

OTHER PUBLICATIONS

International Search Report for PCT/CN2007/002981 completed Dec. 16, 2007.

*Primary Examiner* — Duane Smith
*Assistant Examiner* — Thomas McKenzie
(74) *Attorney, Agent, or Firm* — Buchanan Ingersoll & Rooney PC

(57) ABSTRACT

A self-cleaning device of a filtering net is disposed in a wall-hanging type air conditioner and includes a filtering net with an upper filtering net and a front filtering net, which is disposed outside a heat exchanger and is used for absorbing dust in the air passing through the heat exchanger. A dust sweeping assembly with a detachable brush is disposed outside the filtering net, and is used for sweeping the dust adhered on the filtering net. A drive device with a drive motor and a transmission mechanism is used for driving the dust sweeping assembly to slide on the filtering net to sweep off the dust. A dust box is used for collecting the dust and is detachably disposed in the air conditioner to clear up the dust in the box. A dust exchanging device is disposed on the left or right side of the filtering net, and is used for transferring the dust swept out by the sweeping assembly into the dust box. The self-cleaning device of a filtering net of an air conditioner can clean up the dust on the filtering net in a short time with good clearance effects, and less noise. The structure of the device has high reliability and durability, and is simple.

6 Claims, 5 Drawing Sheets

U.S. PATENT DOCUMENTS

Figure 1:
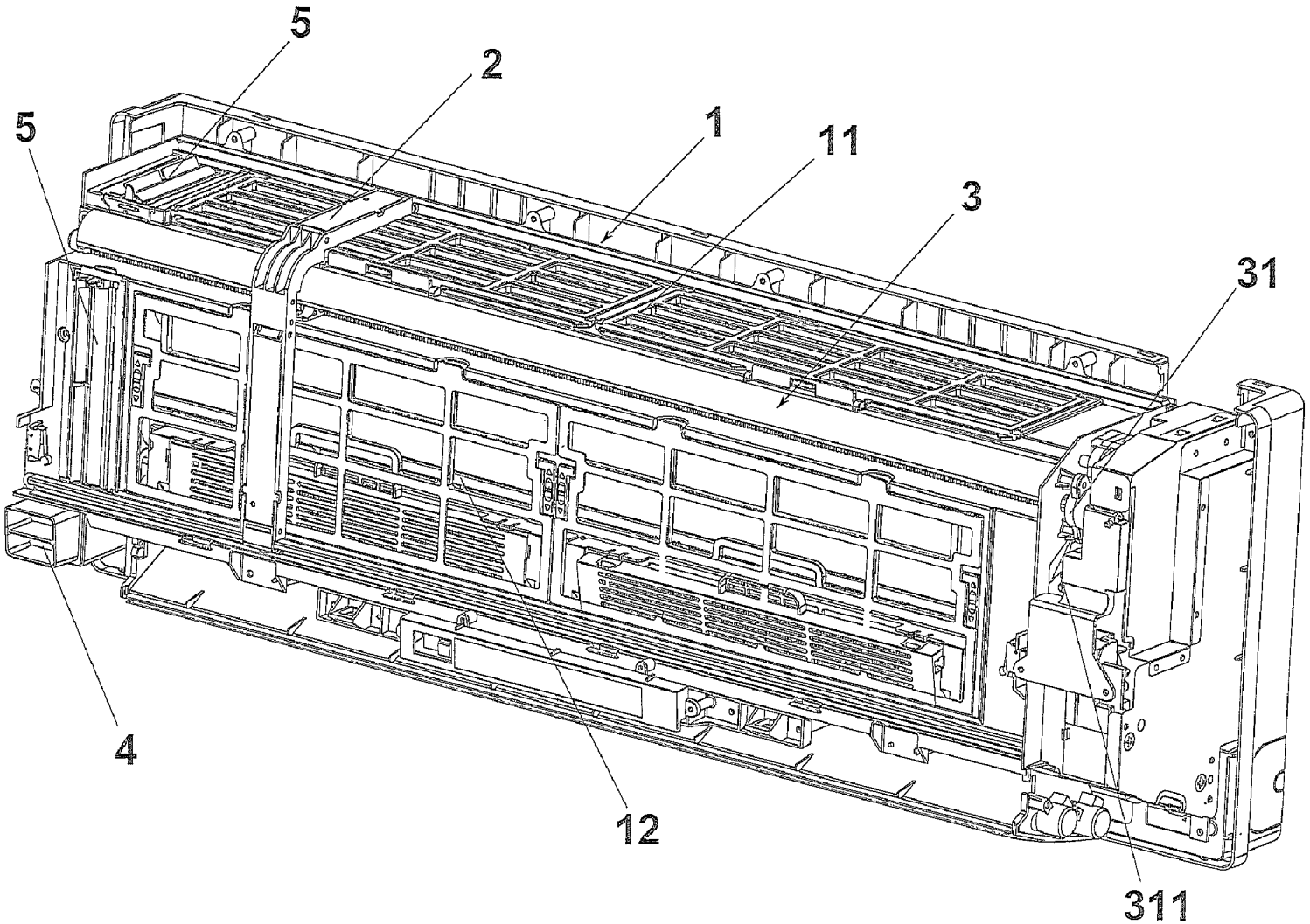

| | | | | |
|---|---|---|---|---|
| 7,544,223 | B2 * | 6/2009 | Oda et al. | 55/289 |
| 2004/0000160 | A1 * | 1/2004 | Takashima et al. | 62/317 |
| 2007/0060036 | A1 * | 3/2007 | Shibuya et al. | 454/187 |

FOREIGN PATENT DOCUMENTS

| | | | |
|---|---|---|---|
| JP | 2004-44933 | A | 2/2004 |

* cited by examiner

SELF-CLEANING DEVICE OF FILTERING NET AND AIR CONDITIONER HAVING IT

FIELD OF THE INVENTION

The present invention relates to an air conditioner device, especially to a self-cleaning device with the characteristic of conveniently dedusting, good dedusting effect and less noise.

BACKGROUND OF THE INVENTION

Room air conditioner commonly adopt a heat exchanger to adjust the indoor temperature, generally speaking, hood a dust filtering device, a dust filtering net on the heat exchanger to prevent the dust. Previously, the dust filtering net is deposited with dust after a period of operating of the room air conditioner. Usually manually cleaning is needed to clean the dust on the filtering net, which is quite troublesome. So we invent a self-cleaning device, which can automatically clean the dust on the filtering net without artificial interference. This device is very convenient to the users.

Chinese application No. 200510120265.6 disclosed a kind of air conditioner with a indoor unit which has the function of automatically cleaning the air filter and the drive mechanism with simple that can exactly drive the dust absorbing section. On the indoor unit of the air conditioner, there is mounted an air filter on the upstream side of the heat exchanger, a slidable suction nozzle having a suction port facing the air filter and sucking dust stuck to the air filter, a drive source for driving the suction nozzle through the drive mechanism, an exhaust device communicating with the suction nozzle and sucking and exhausting dust together with air, and a communicating means for allowing the exhaust device and the suction nozzle to communicate with each other. In addition, the drive mechanism is composed of a diving shaft connected to the drive source, a worm gear slidably mounted to the driving shaft and sliding integrally with the suction nozzle, and a rack meshed with the worm gear. The self-cleaning device of filtering net of above mentioned invention with reliable structure can clean the dust on the filtering net to some degree, but it can not clean the dust thoroughly. The cleaning effect is unfavorable with long time for the device to clean the desert, and complicated structure, discommodious handling, and huge noise.

The present invention discloses a kind of self-cleaning device with good dedusting effects in short time and less noise, considering the above disadvantages. And the device has reliable structure and durability.

SUMMARY OF THE INVENTION

The technical problem to be solved in the present invention overcomes the disadvantage in the prior art, the present invention provides a self-cleaning device of a filtering net which makes less noise, has good dedusting effects and firmly structure.

The other purpose of the present invention is to provide an air conditioner having the self-cleaning device of the filtering net, and more particularly an air conditioner having a sliding panel.

In order to solve the above technical problem, the basic conception of the technical scheme of the present invention is as follows: a self-cleaning device of a filtering net disposed in a wall-mounted air conditioner, including: a filtering net of an air conditioner disposed on the outside of a heat exchanger, which includes an upper filtering net and a front filtering net, and is used for absorbing the dust of the air passing through the heat exchanger; a dust sweeping assembly with a detachable brush, which is disposed on the outside of the filtering net and is used for sweeping the dust on the filtering net; a drive device comprising a drive motor and a transmission mechanism, which is used for driving the dust sweeping assembly to slide on the filtering net to sweep off the dust; a dust box which is used for collecting the dust and is detachably disposed in the air conditioner to clear up the dust in the box; and a dust exchanging device which is disposed on the left or right side of the filtering net, and is used for transferring the dust swept out by the dust sweeping assembly into the dust box.

An air conditioner having the above self-cleaning device of the filtering net includes: a filtering net of an air conditioner disposed outside the heat exchanger, a dust box disposed on the left bottom and right bottom portion of the filtering net, and a panel set on the outside of the filtering net and the dust box, the characteristic is that: the panel includes a upper fixed panel and a lower panel which can slide rightwards or leftwards to conveniently open the dust box.

The dust sweeping assembly includes a basal body with "L" in shape and a slide locating device, the basal body is composed by an upper basal body and a front basal body which are respectively correspondingly located on the outside of the upper filtering net and the front filtering net, the slide locating device located on both ends of the basal body is respectively located in the slide way of the upside of the upper filtering net and the downside of the front filtering net, the slide locating device includes a sliding wheel that can slide along the slide way and a locating block used for preventing the basal body deviating.

Chambers are respectively located in the upper basal body and the front basal body, A brush assembly thrusts into the chambers from the outside of the basal body and is attached with the filtering net inside the basal body. Turnover covers are provided on the basal body corresponding to the chambers to prevent the brush assembly from detaching, and one side of the turnover covers are pin jointed to the basal body by bolts or buckles.

The drive motor is a step motor, which is located on the left or right side of the joint of the upper filtering net and the front filtering net, the transmission mechanism is composed of a drive shaft connected with the drive motor, a wormgear that is freely slidablely located on the drive shaft and rotates together with the drive shaft, and a rack meshed with the wormgear.

The drive shaft with the structure of regular polygonal column is located at the joint of the upper filtering net and the front filtering net in parallel with the rack and, the rack is smoothly located between the upper filtering net and the front filtering net, the drive shaft is disposed above the rack, the wormgear is pin-jointed inside the bend portion of the 'L' shape basal body, and both ends of the rack and/or the drive shaft have travel switches.

The transmission mechanism is composed of a drive shaft with external thread which is connected with the drive motor, and an internal thread which is located on the basal body and screwed on the external thread, the basal body is slidablely located on the screw in parallel with the drive shaft.

The dust exchanging device is a rectangular frame, in which a brush roll for absorbing the dust is pin-jointed brush rolling parallel with the side edge of the filtering net, the brush roll is a circular cylinder or semi-cylinder or elliptical column, a reset mechanism set on the brush roll can be made of a spring or a tension spring, the dust exchanging device is respectively located in the slots set on the left or right side of the upper filtering net and the front filtering net, and there is a communicated dust passage with downward inclination in the bottom of the slots, a dust box slot whose interior is communicated with the slot is located under the slot set on the side of the front filtering net, the dust box being a box structure with a opening that is communicated with the bottom of the slot is pull-pluggably located in the dust box.

Blocks are pin-jointed at both ends of the brush roll, the blocks can freely rotate to the reverse direction of the filtering net and impulse the brush roll to synchronously rotate to the direction of the filtering net, the blocks have reset mechanism, and in the reset state the blocks are oriented to the direction of the hatch of the frame.

The inward extended baffle with a reset mechanism which is parallel with the brush roll is pin-jointed on the side of the brush roll near the filtering net in the frame of the dust exchanging device, a felt is set on the baffle's side near the brush roll to realize a second dust exchanging, a soft baffle is aslant set along the tangent outwards on the other side of the brush roll, and is deflected away from the filtering net.

The exchanging process of the dust includes: the brush on the duct sweeping assembly moving the dust on the filtering net, the sweeping assembly sliding to the dust exchanging device, the block being pushed to press into the frame by the sweeping assembly when it passes through the dust exchanging device, the dust being adsorbed and swept by the brush and the soft baffle in turn, the block being reset after passing the sweeping assembly, the sweeping assembly driving the blocks on both sides of the dust exchanging device to rotate and pushing the brush roll to rotate when it reversely passing through the dust exchanging device, the dust blocked by the brush roll being put into the dust passage and then into the dust box through a dust passage, the brush roll being reset by spring or tension spring after the sweeping assembly slides over the dust exchanging device, the residual dust on the brush roll being cleaned again by the baffle, the brush roll and the soft baffle being reset to seal the hatch of the frame to prevent the dust from being taken out.

The above mentioned technical solution of the invention has following beneficial effects compared with that of the prior art:

The self-cleaning device of the air conditioner of the invention can clear away the dust on the filtering net in a short time with good dedusting effects, less noise, and simple structure with reliability and durability by taking the above mentioned mechanical structure and technical solution.

More preferred embodiments of the invention will be detailedly described combined with the accompanying drawings.

DETAILED DESCRIPTION OF THE DRAWING

Figure 2:
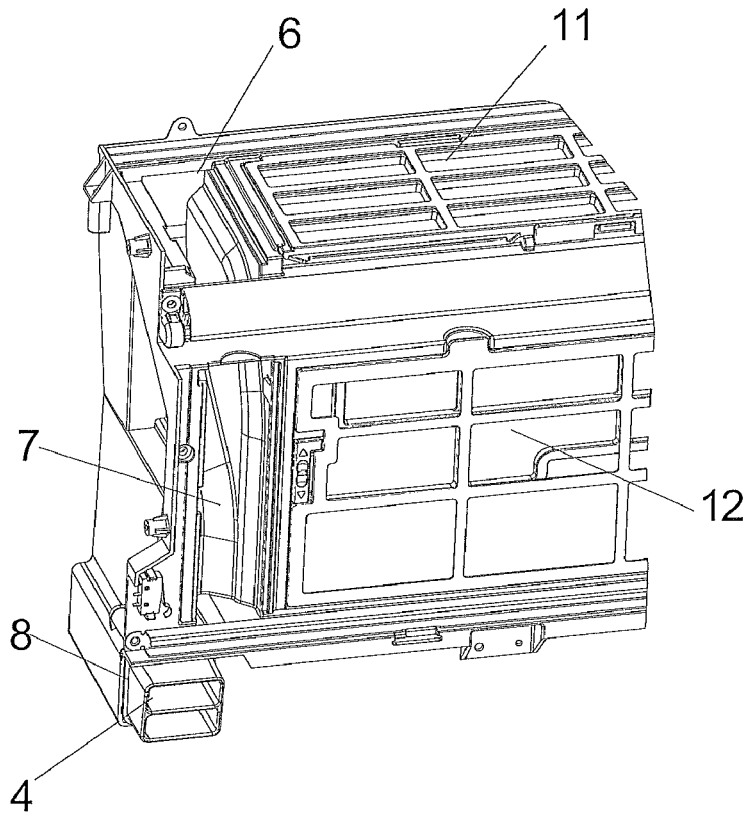
Figure 3:
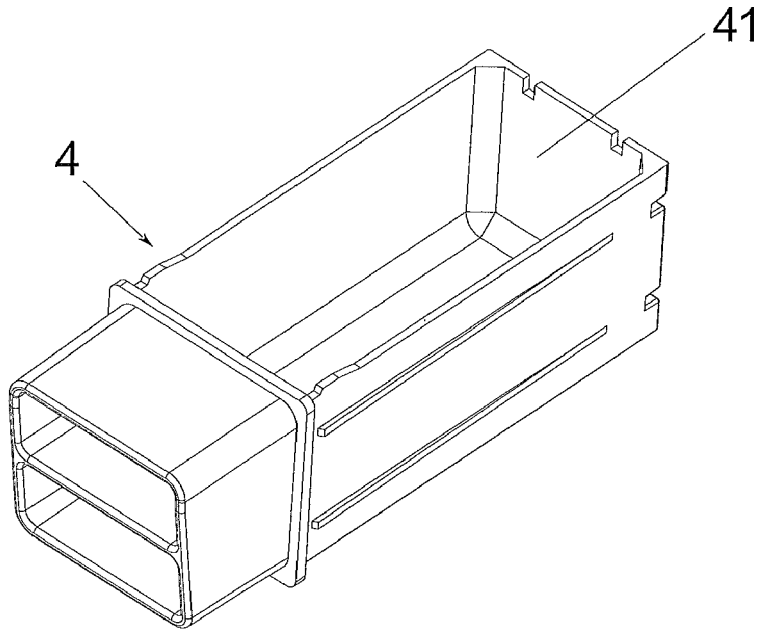
Figure 4:
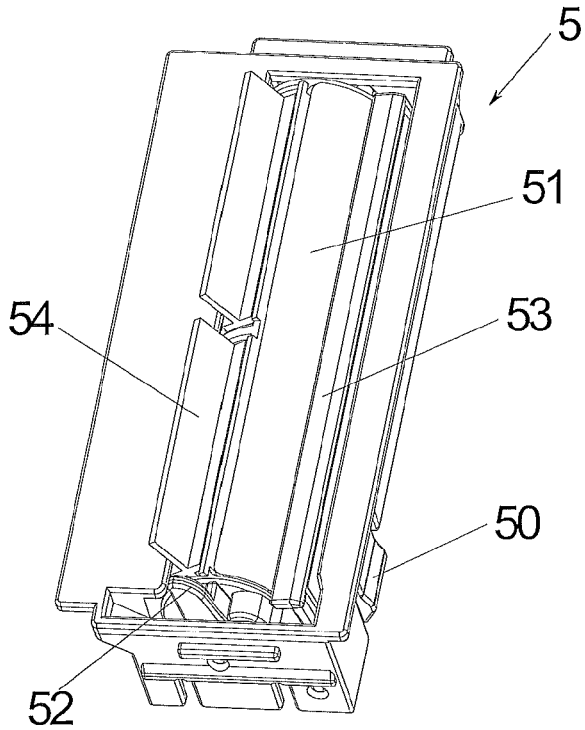
Figure 5:
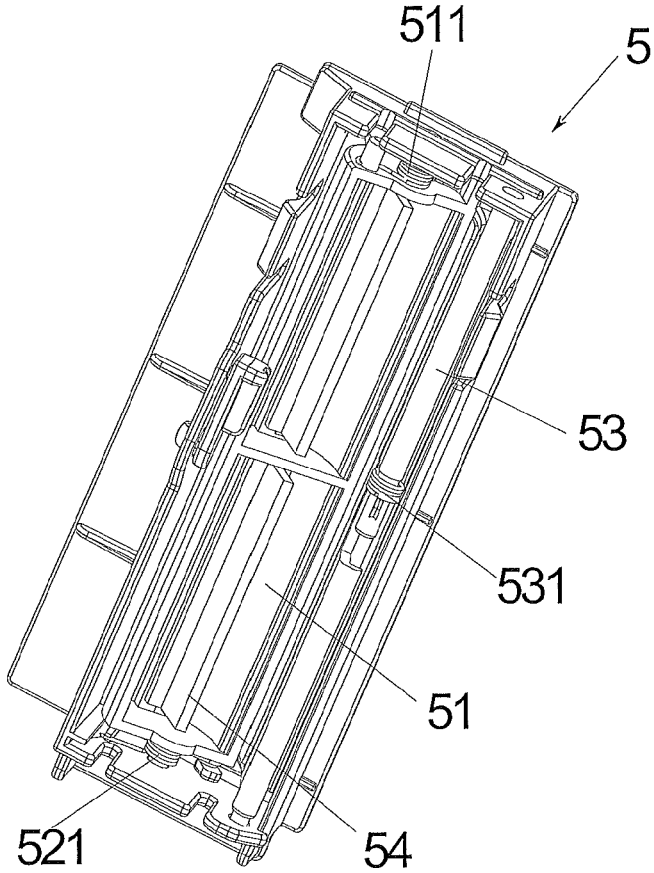
Figure 6:
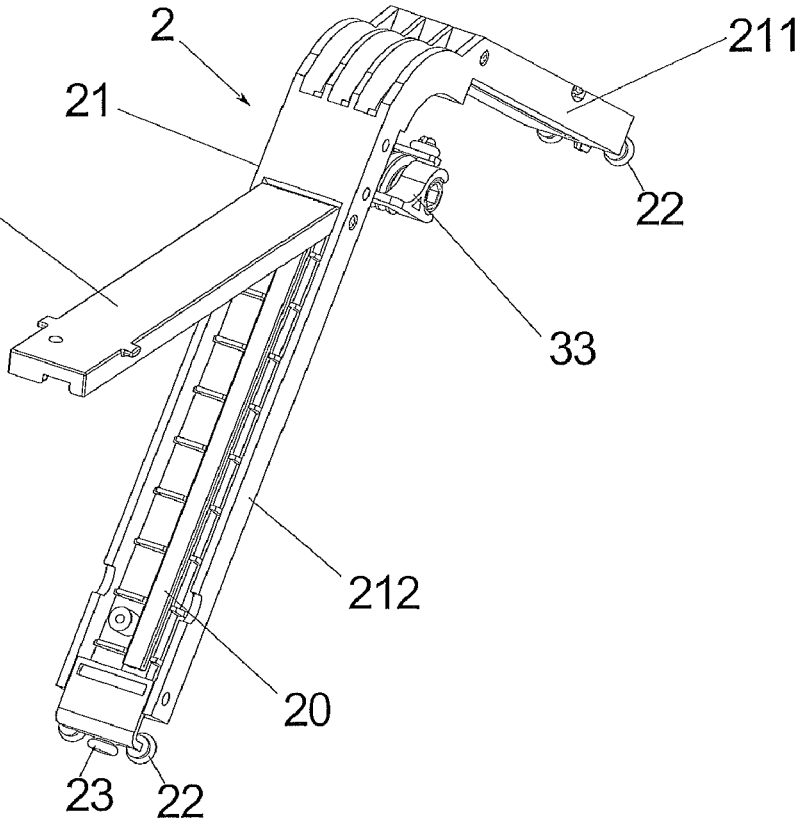
Figure 7:
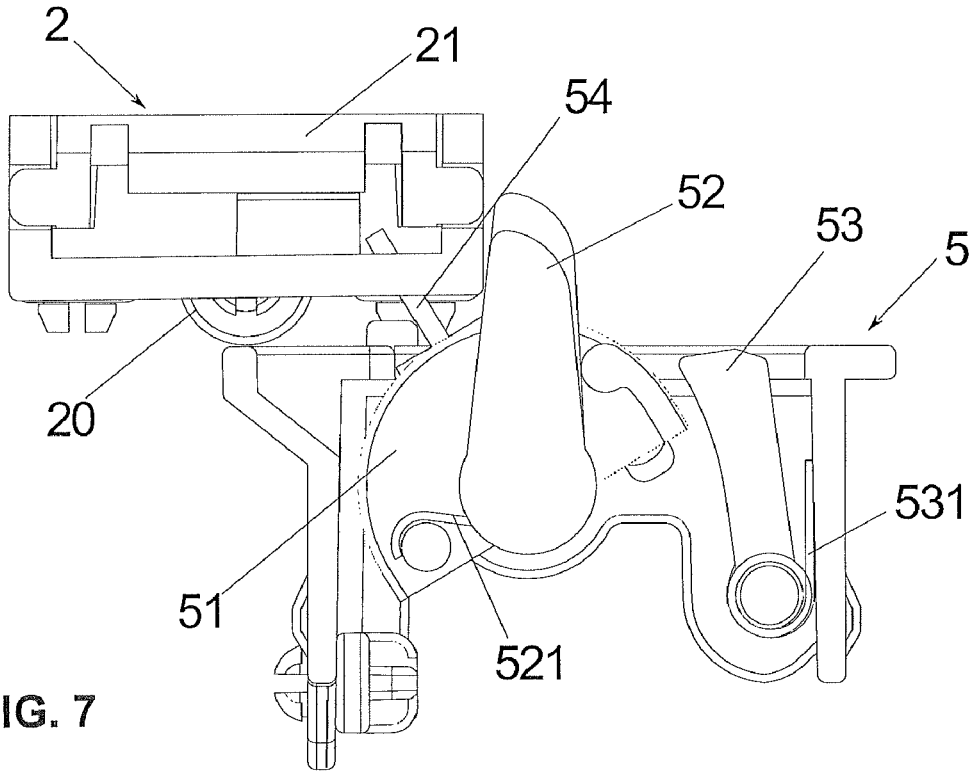
Figure 8:
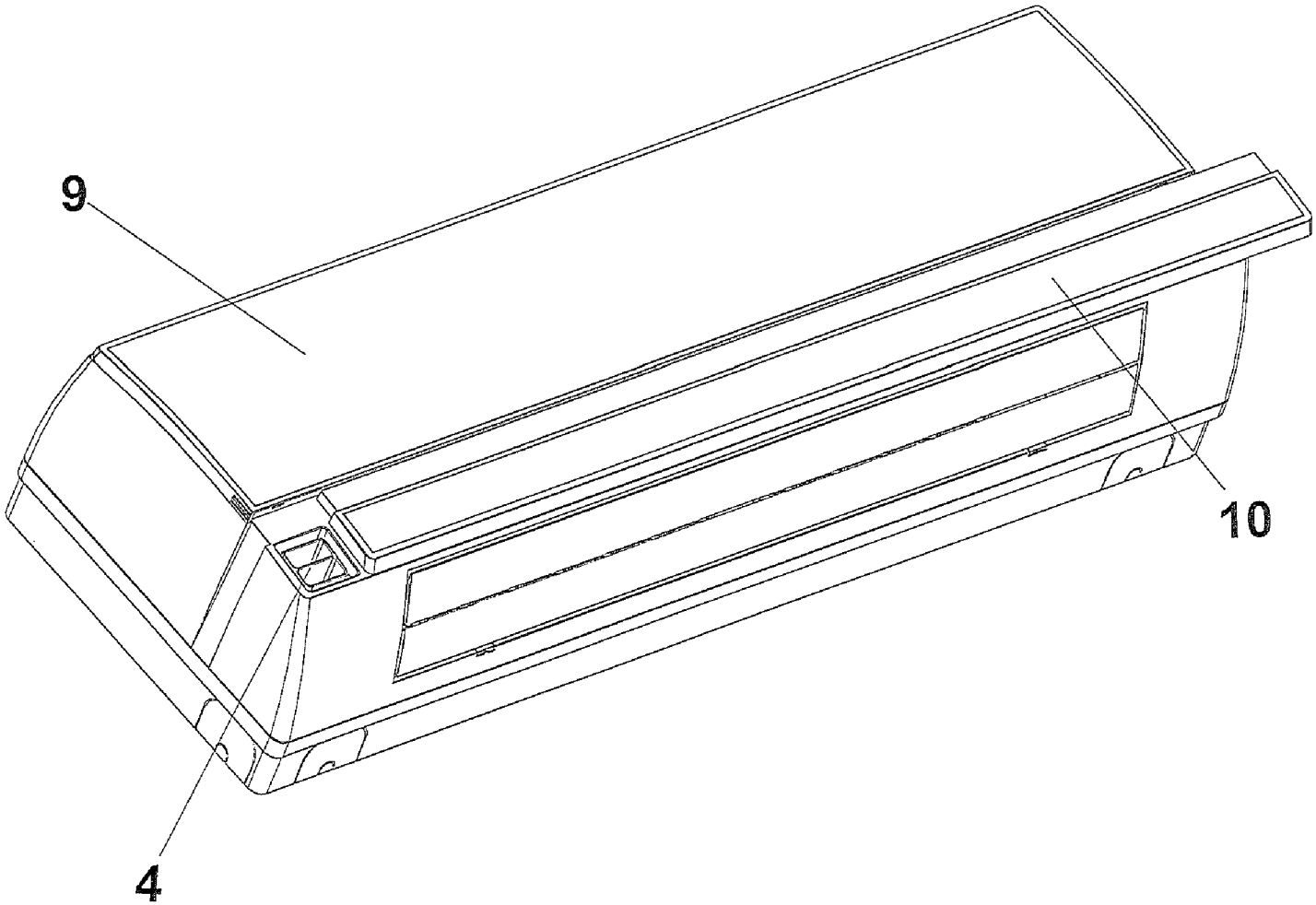

FIG. 1 A structural schematic view of the self-cleaning device on the filtering net of the air conditioner;

FIG. 2 A local schematic view of the position where the dust exchanging device and the dust box of the invention are located;

FIG. 3 A structural schematic view of the dust box of the invention;

FIG. 4 A structural schematic view of the dust exchanging device of the invention;

FIG. 5 A schematic view of another direction showed in FIG. 4;

FIG. 6 A structural schematic view of the dust sweeping assembly of the invention;

FIG. 7 A schematic view of the collecting of the dust of the invention;

FIG. 8 A schematic view of the panel of the air conditioner of the invention.

EMBODIMENT

As shown in FIG. 1, the self-cleaning device of filtering net of the invention which is set in the wall-hanging type air conditioner includes: a filtering net 1 disposed outside of the heat exchanger which includes an upper filtering net 11 and a front filtering net 12, and is used for absorbing the dust of the air passing through the heat exchanger; a dust sweeping assembly 2 with a detachable brush 20 (shown in FIG. 6), which is disposed outside the filtering net 1 and is used for sweeping the dust on the filtering net of the air conditioner; a drive device 3 with a drive motor 31 and a transmission mechanism, which is used for driving the dust sweeping assembly 2 to slide on the filtering net 1 to sweep off the dust; a dust box 4 which is used for collecting the dust and is detachably disposed in the air conditioner to clear up the dust in the box; and a dust exchanging device 5 which is disposed on the left or right side of the filtering net 1, and is used for transferring the dust swept out by the sweeping assembly 2 into the dust box 4.

In this embodiment, the dust exchanging device 5 and the dust box 4 are disposed on the left side of the filtering net 1, the dust exchanging device 5 includes two parts which are respectively disposed on the left side of the upper filtering net 11 and the front filtering net 12, the dust box 4 is located under the dust exchanging device 5 on the left side of the front filtering net 12; The drive motor 31 is disposed on the right side of the filtering net 1.

As shown in FIG. 6, the dust sweeping assembly includes a basal body 21 with 'L' in shape and a slide locating device, that the basal body is composed of an upper basal body 211 and a front basal body 212 which are respectively correspondingly located outside the upper filtering net 11 and the front filtering net 12. The basal body 21 is holistically covered on the filtering net 1, and is fixedly disposed in the slide way of the upside of the upper filtering net 11 and the downside of the front filtering net 12 through the slide locating device respectively disposed on the both ends of the basal body. The slide locating device includes a sliding wheel 22 that can slide along the slide way and a locating block 23 used for preventing the basal body from deviating, which can decrease the vibration of the sliding of the sweeping assembly to reduce the noise.

Wherein, chambers are respectively located in the upper basal body 211 and the front basal body 212 along their length direction. A brush assembly 20 thrusts into the chambers from the outside of the basal body and is attached with the filtering net inside the basal body to realize best sweeping effects. Turnover covers 24 are provided on the basal body 21 corresponding to the chambers to prevent the brush assembly 20 from detaching. The upside of the turnover cover 24 corresponding to the front basal body 212 is pin-joined with the basal body 21, and the downside of the turnover cover 24 corresponding to the upper basal body 211 is pin-joined with the basal body 21. Both of the two turnover covers turn up towards the middle of the bend of the 'L' shaped basal body, and the turnover cover 24 is fixed on the basal body 21 by bolts or buckles. The buckle mechanism (not shown in the FIGs) is non-roundness buttons being usually shape of rectangle or ellipse set on the basal body. An opening matching with the shape of the buttons is disposed on the position of the turnover cover corresponding to the buttons. The buttons passed through the opening are rotated to dislocate the opening and fix the turnover cover after the turnover cover is closed, which makes it easy to change when the brush is frayed.

As shown in FIG. 2, the drive motor 31 is a step motor, which is located on the right side of the joint of the upper filtering net 11 and the front filtering net 12 and fixed inside the electric motor box 311. The transmission mechanism is composed of a drive shaft 32 connected with the drive motor 31, the wormgear 33 that is freely slidable located on the drive shaft 32 and rotate together with the drive shaft, and the rack 34 meshed with the wormgear 33. Wherein, the drive shaft with the structure of regular polygonal column is parallel with the rack 34 and located at the joint of the upper filtering net 11 and the front filtering net 12. The rack 34 is smoothly located between the upper filtering net 11 and the front filtering net 12, and the drive shaft 32 is located above the rack 34. The wormgear 33 is pin-jointed inside the bend portion of the 'L' in shape of the basal body 21 (shown as FIG. 6), and both ends of the rack 34 and/or the drive shaft 32 have travel switches (not shown in the figure) which make the step motor to reversely run when the sweeping assembly reaches the designated position, which cooperates with the slide locating device to reduce the driving noise.

In addition, the transmission mechanism is composed of the drive shaft with external thread which is connected with the drive motor, and the internal thread which is located on the basal body and screwed on the external thread, the basal body is slidable located on the screw in parallel with the drive shaft, which has the same principle as the above mentioned drive system (not shown in the figure).

As shown in FIG. 4 and FIG. 5, the dust exchanging device 5 is a rectangular frame in which a brush roll 51 for absorbing the dust is pin jointed in parallel with the side edge of the filtering net 1, the brush roll 51 is a circular cylinder or semi-cylinder or elliptical column a reset mechanism 511 set on the brush roll can be made of the spring or tension spring, the dust exchanging device 5 is respectively located in the slots 6 set on the left side of the upper filtering net 11 and the front filtering net 12, and there is a communicated dust passage 7 with downward inclination in the bottom of the slots 6, the dust box slot 8 whose interior is communicated with the slot 6 is located under the slot 6 of the left side of the front filtering net 12. The dust box 4 being a box structure with an opening 41 that is communicated with the dust passage 7 is pull-pluggably located in the dust box slot 8. Elastic lugs 50 (shown as FIG. 4) are respectively set on the lateral part of the dust exchanging device and the bottom of the dust box to fix the dust exchanging device 5 and the dust box 4 which are independent each other in the slots and the inner dust box slots to realize the fixing.

The blocks 52 are pin-jointed at both ends of the brush roll 51, the blocks can freely rotate to the reverse direction of the filtering net or to the direction of the filtering net to impulse the brush roll 51 to synchronously rotate, the blocks 52 have the reset mechanism 521, and in the reset state the blocks are oriented to the direction of the hatch of the frame. The block can be reset whenever it rotate to any direction.

The inward extended baffle 53 with a reset mechanism 531 which is parallel with the brush roll 51 is pin-jointed on the side of the brush roll 51 near the filtering net 1 in the frame of the dust exchanging device 5, the felt is set on the baffle's side near the brush roll 51 to realize a second dust exchanging, a soft baffle 54 is aslant set along the tangent outwards on the other side of the brush roll 51, and is deflected away from the filtering net 1.

The exchanging process of the dust includes: the brush on the duct sweeping assembly 2 moving the dust on the filtering net 1, the sweeping assembly 2 sliding to the dust exchanging device 5, the block 52 being pushed to press into the frame by the sweeping assembly 2 when it passes through the dust exchanging device 5, the dust being adsorbed and swept by the brush roll 51 and the soft baffle 54 in turn, the block 52 being reset after passing the sweeping assembly 5 (shown as FIG. 7), the sweeping assembly 2 driving the blocks on both sides of the dust exchanging device to rotate and pushing the brush roll to rotate when it reversely passing through the dust exchanging device 5, the dust blocked by the brush roll 51 being put into the dust passage 7 and then into the dust box 4 through a dust passage 7, the brush roll 51 being reset by spring or tension spring after the sweeping assembly 2 slides over the dust exchanging device 5, the residual dust on the brush roll 51 being cleaned again by the baffle 53, the brush roll 51 and the soft baffle 54 being reset to seal the hatch of the frame to prevent the dust being taken out.

The dust can be stored in the dust box after sweeping each time, which can be cleaned every two to three years according to the operating environment. The invention improves the air-conditioner panel compared with the integral panel of the prior art for the convenience of cleaning the dust in the dust box. In the prior art, the panel must be entirely opened to clean the dust box, which is inconvenient. The present invention adopts a panel which is divided into the upper part and the lower part, the connection relation of the upper fixed panel 9 and the air-conditioner is kept fixed, and the lower panel is the slide panel 10 which can slide rightward and leftward and cover the outside of the dust box 4. It can be taken out for cleaning only by rightward sliding the panel 10 for a distance of the dust box in the process of cleaning. The panel can be replaced after cleaning, which is very convenient.

The self-cleaning device of the air conditioner of the invention can clear away the dust on the filtering net in a short time with good dedusting effects, less noise, and simple structure with reliability and durability.

The invention claimed is:

1. A self-cleaning device disposed in a wall-mounted air conditioner, comprising:

a filtering net disposed on the outside of a heat exchanger, which includes an upper filtering net and a front filtering net, and is used for absorbing the dust of air passing through the heat exchanger;

a dust sweeping assembly with a detachable brush, which is the dust sweeping assembly being disposed on the outside of the filtering net and is used for sweeping the dust on the filtering net;

a drive device with a drive motor and a transmission mechanism, which is used for driving the dust sweeping assembly to slide on the filtering net to sweep off the dust;

a dust box which is used for collecting the dust;

a dust exchanging device which is disposed on the left or right side of the filtering net, and is used for transferring the dust swept out by the dust sweeping assembly into the dust box;

the dust sweeping assembly including a basal body having an 'L' shape and a slide locating device, the basal body being comprised of an upper basal body and a front basal body which are respectively correspondingly located on the outside of the upper filtering net and the front filtering net, the slide locating device being located on both ends of the basal body and respectively located in a slide way of the upside of the upper filtering net and the downside of the front filtering net, the slide locating device including a sliding wheel that can slide along the slide way and a locating block used for preventing the basal body from deviating;

the dust exchanging device being a rectangle frame, in which a brush roll for absorbing the dust is pin-jointed in parallel with a side edge of the filtering net, the brush roll being one of a circular cylinder, a semi-cylinder and a elliptical column, a reset mechanism set on the brush roll being made of one of a spring and a tension spring, the dust exchanging device being respectively located in slots set on the left or right side of the upper filtering net and front filtering net, and there being a communicated dust passage with downward inclination in the bottom of the slots, a dust box slot whose interior is communicated with one of the slots being located under the slot set on the side of the front filtering net, the dust box being a box structure with a opening that is communicated with the bottom of the slot, and being pull-pluggably located in the dust box slot;

wherein blocks are pin-jointed at both ends of the brush roll, the blocks freely rotating in the reverse direction of the filtering net and impulsing the brush roll to synchronously rotate in the direction of the filtering net, the blocks having a reset mechanism, and in a reset state the blocks are oriented in the direction of a hatch of the rectangular frame; and wherein an inward extended baffle with a reset mechanism which is parallel with the brush roll is pin-jointed on the side of the brush roll near the filtering net in the rectangular frame of the dust exchanging device, felt is set on a side of the inward extended baffle near the brush roll to realize a second dust exchanging, and a soft baffle is aslant set along a tangent outwards on the other side of the brush roll, and is deflected away from the filtering net.

2. The self-cleaning device of a filtering net of an air conditioner according to claim 1, wherein chambers are respectively located in the upper basal body and the front basal body, a brush assembly thrusts into the chambers from the outside of the basal body, turnover covers are provided on the basal body corresponding to the chambers to prevent the brush assembly from detaching, and one side of the turnover covers are pin-jointed to the basal body by bolts or buckles.

3. The self-cleaning device of a filtering net of an air conditioner according to claim 1, wherein the drive motor is a step motor, which is located on the left or right side of a joint of the upper filtering net and the front filtering net, the transmission mechanism comprises a drive shaft connected with the drive motor, a wormgear that is freely slidable is located on the drive shaft and rotates together with the drive shaft, and a rack is meshed with the wormgear.

4. The self-cleaning device of a filtering net of an air conditioner according to claim 3, wherein the drive shaft has the structure of regular polygonal column and is located at the joint of the upper filtering net and the front filtering net in parallel with the rack and, the rack is smoothly located between the upper filtering net and the front filtering net, the drive shaft is disposed above the rack, the wormgear is pin-jointed inside the bend portion of the 'L'-shape basal body, and both ends of the rack and/or the drive shaft have travel switches.

5. The self-cleaning device of a filtering net of an air conditioner according to claim 1, wherein the transmission mechanism comprises a drive shaft with external thread which is connected with the drive motor, and an internal thread which is located on the basal body and screwed on the external thread, the basal body is slidable located on the screw in parallel with the drive shaft.

6. The self-cleaning device of a filtering net of an air conditioner according to claim 1, wherein the exchanging process of the dust includes: the brush on the duct sweeping assembly moving the dust on the filtering net, the sweeping assembly sliding to the dust exchanging device, a block being pushed to press into the frame by the sweeping assembly when it passes through the dust exchanging device, the dust being adsorbed and swept by the brush and the soft baffle in turn, the block being reset after passing the sweeping assembly, the sweeping assembly driving the blocks on both sides of the dust exchanging device to rotate and pushing the brush roll to rotate when it reversely passing through the dust exchanging device, the dust blocked by the brush roll being put into the dust passage and then into the dust box through a dust passage, the brush roll being reset by spring or tension spring after the sweeping assembly slides over the dust exchanging device, the residual dust on the brush roll being cleaned again by the baffle, the brush roll and the soft baffle being reset to seal the hatch of the frame to prevent the dust from being taken out.

* * * * *